United States Patent [19]

Kronstein

[11] 4,233,088

[45] Nov. 11, 1980

[54] PHOSPHATIZATION OF STEEL SURFACES AND METAL-COATED SURFACES

[75] Inventor: Max Kronstein, Bronx, N.Y.

[73] Assignee: International Lead Zinc Research Organization, Inc., New York, N.Y.

[21] Appl. No.: 24,966

[22] Filed: Mar. 29, 1979

[51] Int. Cl.[3] ..... C23F 7/10; C23F 7/12

[52] U.S. Cl. ..... 148/6.16; 148/6.15 R

[58] Field of Search ..... 148/6.15 R, 6.15 Z, 148/6.16

[56] References Cited

U.S. PATENT DOCUMENTS

| | | | |
|---|---|---|---|
| 1,069,903 | 8/1913 | Richards | 148/6.15 R |
| 1,311,319 | 7/1919 | Colquhonn | 148/6.15 R |
| 1,514,494 | 11/1924 | Williams | 148/6.15 Z |
| 1,677,667 | 7/1928 | Zimmerman | 148/6.15 R |
| 2,046,061 | 6/1936 | Curtin | 148/6.15 R |
| 2,132,883 | 11/1938 | Romig | 148/6.15 Z |
| 2,854,370 | 9/1958 | Kronstein | 148/6.15 R |
| 3,272,663 | 9/1966 | Kronstein | 148/6.16 |
| 3,528,860 | 9/1970 | Kronstein | 148/6.15 R |
| 3,819,385 | 6/1974 | Schumichen et al. | 148/6.15 Z |

OTHER PUBLICATIONS

Kronstein, Australian Paint Journal, Jun. 1966, vol. 12, No. 3, pp. 13–21.

*Primary Examiner*—Ralph S. Kendall

*Attorney, Agent, or Firm*—Brumbaugh, Graves, Donohue & Raymond

[57] ABSTRACT

A process for inhibiting corrosion and providing a foundation for subsequent application of organic coating systems to metal surfaces, such as steel surfaces and zinc-, lead-, copper- and tin-coated surfaces, comprises the development of a protective phosphatizing reaction coating based on a metal other than the metal which is to be protected either by an immersion treatment or by a spray treatment with a phosphatizing bath which contains the metal phosphate or metal acid phosphate matter for such a treatment in a status nascendi. Such a state is obtained by the use of an aqueous medium containing phosphate ions derived from an alkali metal phosphate, an alkali metal acid phosphate, phosphoric acid or combinations of those and introducing into the aqueous medium a metal oxide based on a metal other than that which is to be treated, preferably an oxide of the metal group of molybdenum, vanadium, tungsten, titanium, lead, manganese and copper, whereby the metal oxide in the aqueous medium forms with the phosphate ions of the aqueous medium the desired freshly prepared metal phosphate or metal acid phosphate to develop on the treated metal surface the required protective reaction coating. The phosphatizing bath can be modified further by introducing into the aqueous medium a ligand-forming organic polymer which is capable of entering the reaction coating formation and said polymer can further be influenced also by the addition into the aqueous medium of a small amount of an acetylenic alcohol or a dialdehyde. Also a dispersing agent, such as formamide or an alkyl-substituted formamide, can be employed to increase the reactivity of the metal oxide component.

21 Claims, No Drawings

PHOSPHATIZATION OF STEEL SURFACES AND METAL-COATED SURFACES

The present invention is concerned with the modification of steel surfaces and metal coated surfaces, in particular zinc-coated (including galvanized) steel, with the objective of making them suitable to serve as substrates for protective and decorative organic coating systems. Such applications are aimed, for instance, at producing increased corrosion resistance on automotive structures and on appliances.

Plain or carbon steel surfaces readily corrode and organic coating systems applied thereon will then lose adherence. In particular, any local damage of the applied organic coating results in a progressive spreading of the corrosion area, even underneath an outer still intact organic coating film. Therefore, techniques have been developed heretofore for modifying such plain or carbon steel surfaces so as to decrease their progressive corrosion, the surfaces first being mechanically or chemically precleaned and chemically deactivated.

One of the most widely used techniques for modifying the precleaned plain or carbon steel surfaces is the application of so-called "phosphatizing" solutions. However, the phosphatizing technique is limited in its effectiveness by the fact that even such high grade steels as automotive steel can frequently contain local areas which do not participate in the phosphatizing effect, for example, local areas of carbonaceous deposits, and such local areas will allow the progressive deterioration or corrosion of the phosphatized steel surfaces.

The deposition of metal coatings or the galvanization of the plain steel surfaces will overcome such local defects. Moreover, it has been known that an application of certain inorganic new layers, such as a deposition of another metal coating on the plain steel, decreases considerably the tendency of such coated steel surfaces to corrode. Such metal coatings include zinc or lead or copper or tin coatings which are applied by some form of deposition, such as by electrodeposition or, particularly in the case of zinc coatings, by galvanization.

On the other hand, such metal depositions are poorly suitable as substrata for decorative organic coating systems, because the subsequently applied organic coating systems do not adhere well thereon. In the case of zinc-coated or galvanized steel there is the additional factor that the galvanized steel surface shows an irregular appearance due to a surface condition which is usually described as the formation of a "spangle" pattern. This spangle is not concealed by subsequent application of organic coatings alone.

Attempts have been made to overcome this spangle by the application of the same phosphatizing treatment as used on plain steel surfaces. However, the fact remains that the phosphatizing of galvanized steel surfaces is less effective than the phosphatizing of plain steel surfaces under the same procedures.

The preliminary step of precleaning the metal surface of plain steel or automotive steel before chemical modification can readily be carried out by any alkaline cleaning procedure. However, when such alkaline cleaning procedure is used on galvanized steel, an undesirable extensive loss of zinc coating material occurs, because of the higher solubility of the zinc coating compared to that of plain steel. This difficulty can be overcome by precleaning galvanized steel with a less alkaline solution containing surfactants and silicates (even containing biodegradable surfactants) and serving in the industry for the cleaning of aluminum. Such mild cleaning solutions have a very low dissolving effect on the zinc coating of galvanized steel surfaces. Nevertheless, it required the present invention to proceed from this state of the art to obtain successful phosphatizing effects on galvanized steel surfaces such as those to be used in industrial production of automotive structures and appliances.

In the prior art it had been attempted to apply to galvanized steel surfaces phosphatizing solutions of the same or similar kind as used on plain steel or ferrous metal surfaces. These phosphatizing solutions included either sodium acid phosphate (monobasic solutions with their usual additives as used in so-called "iron phosphate" treatment or zinc acid phosphate (monobasic) solutions with the usual additives as used in so-called "zinc phosphate" treatment. It had been recommended also to add small amounts of additional additives when using such phosphatizing solutions (as prepared for the treatment of plain steel surfaces) on zinc surfaces.

However, the present invention has established that an effective phosphatizing of metal surfaces (such as zinc deposits in galvanized steel) requires phosphatizing baths or solutions which are based on either metal phosphates or metal acid phosphates of metals other than the metal (e.g., zinc) of the metal surface. In particular, the present invention has established that metal phosphates or metal acid phosphates are most effective when based on such metals as molybdenum, vanadium, tungsten, lead, titanium, manganese or copper.

It is not necessary to produce first such metal phosphates or metal acid phosphates in a preliminary procedure. Instead, it is also possible, and in effectiveness even preferable, to produce such phosphates in situ within the phosphatizing solution so that such phosphates are in a status nascendi. This preferred procedure also avoids any crystalline sedimentations as might form when preparing a phosphatizing solution from such previously produced phosphates. Such an in situ prepared phosphatizing solution can be obtained by introducing a metal oxide (such as an oxide of molybdenum or an oxide of the other above-listed metals) into an aqueous medium containing phosphate ions released from the dissolving or dispersing of an alkali metal phosphate or an alkali metal acid phosphate or phosphoric acid or combinations thereof. The phosphatizing solution so formed of the resulting metal phosphates or metal acid phosphates can be used to react with or phosphatize galvanized steel surfaces containing zinc deposits, or plain or carbon steel surfaces (such as automotive steel), or joints between plain or carbon steel surfaces and galvanized steel surfaces, or surfaces coated with zinc, lead or copper or tin.

The reaction between the introduced metal oxide and the phosphate ions might represent the formation of either an actual new metal phosphate or metal acid phosphate or a complex. [Hori and Toshitaka assumed (Journal Inorganic Nuclear Chemistry, 1977, Vol. 39, pp. 2173–2177; Chemical Abstracts, August 7, 1978, p. 372, Ref. No. 49630g) that the reaction between molybdates and phosphorus compounds represents the formation of complexes containing the metal oxides as well as the phosphoric acid groups.] For the objectives of the present invention, it is essential that the resulting products in the phosphatizing solution be able to further interreact with the plain or carbon steel surface or with the zinc matter of the galvanized steel surface (or with the metal coating of a metal coated surface).

Such interreaction represents a formation between the phosphate ions and the introduced metal oxide of the phosphatizing solution or bath and the zinc (or other metal) surface to which the phosphatizing bath has been applied of a reaction product which contains zinc (or other metal) phosphate (of a primary or of a higher kind). The reaction product is formed on the galvanized steel surface to produce molybdenum/zinc phosphate coatings or other corresponding metal/zinc phosphate coatings. (Even a mixture of solutions of such newly formed metal phosphates or metal acid phosphates with solutions of zinc phosphate or zinc acid phosphate can be applied as the phosphatizing solution to the galvanized steel surfaces and can further participate in the new coating formations).

This formation corresponds to the fact that an application of a sodium acid phosphate solution (in the presence of some phosphoric acid) to ferrous metal surfaces results in the formation of so-called "iron phosphate" coatings. Also an application of zinc phosphate solutions to ferrous metal surfaces results in zinc-iron phosphate coatings. The present inventor developed earlier an analytical method, based on an emission spectroscopic procedure, which shows that an applied zinc phosphate treatment on steel, having the commercial degree of coating referred to as "coating weight" of about 300 mg./sq. ft. of surface, contains as much as 38.5 mg. iron and 20.83 mg. phosphorus to 100 mg. zinc in the applied coating. (Kronstein and Heinzelman, "Phosphate Coatings on Steel as Chemical Complex Formations", in papers presented at the New York meeting, September 1966, Preprints of the Division of the American Chemical Society Division of Organic Coatings and Plastics Chemistry, Vol. 26, No. 2, pp. 293–303, Table 7)

However, the same zinc phosphate solution cannot be expected to produce corresponding interreaction products when applied to zinc-coated surfaces. On the other hand, the same zinc coatings or galvanized steel surfaces can interreact with the phosphatizing solutions of the present invention based on the contained metal groupings of this process. Also, lead-, copper- or tin-coated surfaces can interreact with the phosphatizing baths of the present invention.

New methods have been developed also to follow analytically the present invention, utilizing atomic absorption analysis of the phosphatizing baths as well as the coating reaction products.

Such new molybdenum, vanadium, tungsten, lead, titanium, manganese or copper phosphates or acid phosphates can be obtained for the use in the new phosphatizing processes either by introducing anhydrides or oxides of said metals directly into an aqueous medium containing alkali metal phosphate (such as sodium phosphate) or alkali metal acid phosphate (preferably under addition of some phosphoric acid) or by introducing said metal anhydrides or oxides into phosphoric acid using approximately stoichiometric amounts (e.g., using about one mole molybdic anhydride introduced to about two moles of available phosphate ions) or into its aqueous solutions, and proceeding from there in the formation of the phosphatizing solution. Alternatively, a coating of increased density and coherence on the zinc-coated (galvanized) steel surfaces can be obtained by introducing organic polymer groupings as "ligands" into the phosphatizing solution and hence thereafter into the reaction products formed on the phosphatized galvanized steel surfaces. The interreaction between the ligand-forming organic polymer and said reaction products is even increased when the ligand-forming organic polymer is introduced into the phosphatizing solution while the new metal phosphate or metal acid phosphate is being formed therein. Both these ways of producing the phosphatizing solutions of the present invention are shown in the Examples 1 to 4 below.

EXAMPLES

Example 1

Introducing the new Metal Component into an Initial Phosphatizing Solution Based on an Alkali Metal Phosphate The direct introducing of the new metal groupings into the phosphatizing solution was obtained by dissolving 55 g. sodium acid phosphate (monobasic) in 192 g. water with addition of 4 g. phosphoric acid (85%) and heating at 60° C.–80° C. until a clear solution had been obtained. 6 g. Molybdenum anhydride in the form of a commercial molybdenum trioxide (commercial Type M of the Climax Molybdenum Company) were introduced into the hot acidic solution, whereby a new clear solution was formed containing the newly formed molybdenum acid phosphate groupings. (This state of the solution is referred to as the "concentrated solution" and can also be used as a "refresher solution".) For use as a phosphatizing solution or bath it was diluted with 1100 ml. of water and the dilute solution was heated and stirred at 60° C.–80° C., whereafter immersed galvanized steel panels (10 cm.×30 cm.) showed the formation of the desired phosphatizing reaction coating.

However, this initially only slight blueish phosphatizing solution turned deep blue under successive immersion of about three galvanized steel panels due to the formation of interreaction products between the phosphatizing solution and the galvanized steel panels. The dispersion of the metal oxide for this process can further be increased by the dispersion of such metal oxide in formamide or an alkylsubstituted formamide, e.g., dimethyl formamide.

The coating formation progressed on the galvanized steel panels and the developing coating turned dark due to this formation and it turned water-insoluble. This progress was slow and therefore it might sometimes not clearly surpass the rate of zinc loss by the immersion of the galvanized steel panels in the phosphatizing solution. In order to increase the rate of such coating and to obtain more effective phosphatizing deposits, the process was further modified according to Examples 2 and 3 below.

Example 2

Introducing an Organic Polymer Component into the Phosphatizing Solution

Coatings of a higher coating weight and of desirable properties are obtained by incorporating organic polymer groupings into the phosphatizing solution and hence into the reaction products of the coating. Thus, instead of using the molybdenum (or other above-listed metals) acid phosphate (or phosphate) formations in an inorganic form as a protective coating to the galvanized steel surface, an organic polymer component can be added to the phosphatizing solution and forms a joint compound or ligand with said metal acid phosphate (or phosphate), whereby the organic polymer grouping also becomes a part of the reaction coating. The organic polymer component can be a water-dispersible polyvinyl alcohol, methyl cellulose or any other water-dispersible organic polymer capable of forming a ligand with said metal acid phosphate (or phosphate) and capable of becoming a part of the reaction coating on galvanized steel. The degree of the final cure of the developed treatment with its polymer component can further be increased by the addition of certain accelerator materials, such as dialdehydes, e.g., glyoxal.

Therefore, even when the applied reaction product is being removed from the phosphatized galvanized steel surface by a conventional hydrochloric acid/formaldehyde stripping solution and the stripping solution has been further diluted with water, a subsequent ether extract of the organic polymer matter from the water solution can still identify the introduced organic polymer groupings in the infrared spectrum. This establishes that in the use of the organic polymer component according to this Example 2 (and in the following Example 3), the resulting phosphatized coating represents a different product from that where the phosphatization has been applied in accordance with Example 1 without such organic polymer component.

Such a phosphatizing treatment can be obtained following the procedure below.

As an initially separate dispersion, 30 g. of a water-dispersible polyvinyl alcohol (ELVANOL 90-50 of the Dupont deNemours Company) was added to 480 g. water. It was heated around 60° C.-80° C. with mixing or magnetic stirring until clear.

In a third step, 30 lg. molybdenum trioxide (same as in Example 1) was forest dispersed in 90 g. water, or it was tion of 29 g. phosphoric acid (85%) in the same manner as in Example 1.

In a third step, 30 l g. molybdenum trioxide (same as in Example 1) was first dispersed in 90 g. water, or it was dispersed first in 5 g. dimethyl formamide and 90 g. water was added to the dispersion, or the 30 g. molybdenum trioxide was refluxed in 5 g. dimethyl formamide until the initial greenish dispersion had turned yellowish and 90 g. water was added to the dispersion. Then the third step solution was combined with the second step solution with heating and stirring at 60° C.-80° C. until a clear solution was formed. The same procedure can be carried out using here vanadium pentoxide, tungsten trioxide, titanium dioxide, cuprous oxide, lead monoxide or manganese dioxide as the metal oxide material.

After the first step dispersion of the organic polymer matter had been diluted with one and a half gallons of water, the combination of the two other solutions was added and the resulting solution was stirred by a rotating pump and heated at 60° C.-80° C. Hereby within the solution the water-dispersed organic polymer ligand can participate in the formation of an interreaction between the molybdenum trioxide with the phosphoric ions of the solution of the second step and can so become a component of the complex reaction coating. Eventually 5 g. of an anti-foaming agent (NOPCO NXZ of Diamond Shamrock Co.) was added.

The so-prepared solution can be used directly for the phosphatizing of galvanized steel. Moreover, it can be used also for the phosphatizing of plain or automotive steel or of joints between plain and galvanized steel. In addition, it can be used for the phosphatizing of one-sided galvanized steel, i.e., steel which has been galvanized or zinc-coated on one side only, but whose other side still is a plain steel surface.

The preferred pH of the phosphatizing solution is between 2.8 and 3.4. The coating which contains the organic polymer ligand is a denser and more coherent coating than the inorganic coating. The ligand also provides a higher uniformity of the coating. The ligand-containing coating is less readily damaged by mechanical scratching and hence the steel surface underneath is better protected from progressive corrosion.

Corresponding dispersions were obtained from vanadium pentoxide ($V_2O_5$), but the resulting clear brown phosphatizing solution required some filtration, because the vanadium pentoxide is less reactive than molybdenum trioxide. Also, tungsten trioxide ($WO_3$) or the other above-listed metal oxides were introduced into such phosphatizing solutions in a corresponding manner.

The application of the phosphatizing solution can be performed by immersing the metal surfaces into the heated solution or by spraying the heated solution under pressure upon the metal surfaces.

Example 3

Use of Methyl Cellulose as the Ligand-Forming Organic Polymer

Here the same formulations were used as before in Example 2 when polyvinyl alcohol was used. The methyl cellulose used was DOW METHOCEL A 15 PREMIUM.

Since methyl cellulose usually requires an additional treatment-component to turn its application water-insoluble, two different such agents were included, either citric acid which is a polybasic acid

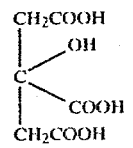

or glyoxal which is a dialdehyde

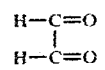

These treatments were carried out using:

| Solution A | | |
|---|---|---|
| 6 g. | Methocel | 6 g. |
| 300 g. | water | 300 g. |
| 5 ml. | dimethyl formamide | 5 ml. |

Solution A was heated until clear and then added to 1000 ml. water.

| Solution B | | |
|---|---|---|
| 55 g. | sodium acid phosphate (monobasic) | 55 g. |
| 4 g. | phosphoric acid | 4 g. |
| 6 g. | citric acid | — |
| — | glyoxal (40% water solution) | 30 g. |
| 192 g. | water | 192 g. |
| 6 g. | molybdenum trioxide | 6 g. |

Solution B was heated until clear and then added to

| Solution A. | |
|---|---|
| pH: about 6 | Color: Dark blue in Solution B<br>% Transmittance: 40%<br>pH of whole Solution A plus Solution B: 2 |

The application was the same as with polyvinyl alcohol.

Resulting stripping weight on automotive steel:

| With citric acid | | With glyoxal | |
|---|---|---|---|
| Test I: | 92.09 mg./sq.ft. | Test I: | 138.1 mg./sq.ft. |
| Test II: | 99.85 mg./sq.ft. | Test II: | 128.3 mg./sq.ft. |
| Average | 95.97 mg./sq.ft. | Average | 133.2 mg./sq.ft. |

Example 4

Reacting the Molybdenum Anhydride with Phosphoric Acid and Introducing the Organic Polymer Component into the Water Solution Aiming for a formation of the molybdenum phosphate (or molybdenum acid phosphate) in the phosphatizing solution, phosphoric acid and molybdenum anhydride were introduced into the water solution at a ratio of approximately three moles phosphoric acid (294 g.) to one mole molybdenum anhydride (144 g.) eventually in the presence of 1000 ml. water and the solution was heated until clear. Alternatively, the phosphoric groupings were introduced into the molybdenum trioxide by the interreaction in the water of three moles sodium acid phosphate (414 g. Na $H_2PO_4 \cdot H_2O$) with one mole molybdenum trioxide (144 g.) and the water solution was heated until clear. Also corresponding relations were used, namely using 55 g. $H_3PO_4$ and 26.9 g. $MoO_3$ in 192 g. water or heating 77.3 g. Na $H_2PO_4.H_2O$ with 26.9 g. $MoO_3$ in 192 g. water until clear solutions were obtained. These were combined with a solution of 6 g. polyvinyl alcohol (ELVANOL 90-50) in 96 g. water. (These combined solutions are referred to as the "concentrated solution" and are used in later examples as a "refresher solution".) For use in the phosphatizing treatment they were diluted with 1200 ml. water for application as phosphatizing solutions either using an immersion bath or a spray application.

Example 5

Combined Application of a Phosphatizing Solution Containing Molybdenum Phosphate with some Zinc Phosphate When galvanized steel is being immersed into a phosphatizing solution having an acidic pH, some zinc matter can be dissolved and can enter the phosphatizing solution. In the case of the phosphatizing solutions of Examples 1–4, such a solution would contain phosphate ions in the solution and would result in the formation of some zinc phosphate component in the solution. However, it was established that this would not interfere with the subsequent formation of the reaction coatings of this invention, but rather would become an additional component in said coating, as shown below.

Thus, the solutions containing molybdenum phosphate (or molybdenum acid phosphate) can be combined with another solution containing zinc phosphate (or zinc acid phosphate). For instance, a solution based on the formation of 6 g. molybdenum phosphate can be combined with another solution containing 12 g. zinc acid phosphate [$Zn(H_2PO_4)_2.2H_2O$]; such solutions can be combined in various ratios; and the combined solutions have been found to produce joint phosphate coatings on immersed steel.

Example 5A

It was further established that the free phosphate ions in the phosphatizing solutions are so reactive that they can in the status nascendi form new metal phosphates even from such metal oxides as titanium dioxide (rutile) which are hardly soluble in acidic solutions. Thus, according to the CRC Handbook of Chemistry and Physics, 53rd Edition, page B-150, titanium dioxide is insoluble in acids except $H_2SO_4$. However, when it is introduced into the phosphatizing solution of Example 2 (instead of the molybdenum trioxide) it enters the diluted acidic solution containing the phosphoric ions and turns into a titanium phosphate, which can be deposited on bare steel as well as on galvanized steel.

This was established as follows: A solution was prepared of 6 g. polyvinyl alcohol (ELVANOL 90-50) in 96 g. water, heated until clearly dispersed and diluted with 1200 ml. water. A second solution was prepared from 55 g. sodium acid phosphate (monobasic), 192 g. water and 4 g. phosphoric acid. It was heated until clear. Then 6 g. titanium dioxide (rutile) were dispersed in 4 g. dimethyl formamide or they were refluxed with 4 g. dimethyl formamide and 18 g. water. They were then introduced into the solution containing the phosphoric acid components. It had a pH around 3. Most of the titanium dioxide went into solution as titanium phosphate. The solution was then filtered and added to the diluted polyvinyl alcohol solution. When the resulting phosphatizing bath was heated at about 60°–80° C., immersed automotive steel panels or galvanized steel panels received quickly a dense deposition of a titanium phosphate coating, which actually represents a complex titanium/iron or titanium/zinc phosphate with an organo-polymer ligand. In the case of so-coated automotive steel a stripping weight of 72.44 mg./sq.ft. was found.

Example 6

Establishing the Relation of the Metal Surface to Metal Components of the Phosphatizing Solution It has been pointed out that the phosphate coating represents interreaction products between the metal phosphate component in the phosphatizing solution and the metal surface to which it is being applied. Earlier papers of the inventor have shown analytical studies establishing that a zinc phosphate coating applied to steel consists of a zinc/iron phosphate and that such interreaction products therefore require that the phosphatizing solution applied to one metal should contain the phosphate or acid phosphate of another metal.

To demonstrate this fact on the present phosphatizing solutions, the phosphatizing solution of Example 2 was prepared again, but introducing instead of molybdenum trioxide a cuprous oxide ($Cu_2O$) and using the so-obtained solution at a pH 3.

By the interreaction between such cuprous oxide with the acidic phosphate ions of the prepared phosphatizing solution, copper phosphate ions were formed in the solution. When this phosphatizing bath was used for the immersion of a bare steel panel, such as automotive steel, a dark reddish brown reaction coating was obtained, whereby the copper phosphate had interreacted with the steel surface. In the same way, a dark brownish red coating was obtained when a galvanized steel panel was immersed and again this formation results from the interreaction between the copper phosphate with the metal of the immersed surface. However, when a sheet of copper was immersed in the same manner, no coating was deposited on the copper surface.

Example 7

Varying the Amounts of Certain Components in the Phosphatizing Baths (a) In order to establish that the amount of the molybdenum trioxide component is not critical, the same phosphatizing bath of Example 2 was used with twice the amount of molybdenum trioxide. It was even introduced into the sodium monobasic phosphate-phosphoric acid solution directly and the solution was applied again to plain steel surfaces as well as to galvanized steel surfaces and effective phosphatized reaction coatings were obtained.

(b) In order to establish that the amount of the organic polymer component is not critical, the phosphatizing solution of Example 2 was prepared using half the amount of polyvinyl alcohol and again using twice the amount of polyvinyl alcohol and in both cases effective phosphatized reaction coatings were obtained on plain steel surfaces and on galvanized steel surfaces. However, in removing the reaction coatings later by the above conventional stripping method and by then determining the amount of the strippable reaction coating, it was determined that by using only half the amount of the organic polymer component less phosphatized reaction coating was obtained on the surface. In fact, the reaction coating weight decreased with a lowering of the organic polymer component. On the other hand, by doubling the amount of the organic polymer component, all the components were no longer capable of interreacting fully and therefore not all parts of the applied coating turned into the desired insoluble form. Therefore, the coating weight of the actually remaining surface coating decreased rather than increased when too much organic polymer matter was used. The data of Example 2 therefore represent preferred amounts of the organic polymer compound.

Example 8

Increasing the Polymeric Condition in the Phosphatizing Bath

Since the organic polymer component used in Example 2 was used in a low polymeric form so as to allow its ready dispersion in water, it might be desirable to increase later the polymeric state of the completed phosphatizing solution before application to the galvanized steel. This was accomplished by adding, if desired, small amounts of an acetylenic alcohol to the phosphatizing solution, for example, 3-methyl-1-pentyn-3-ol

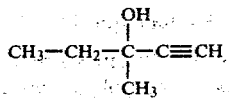

or 2,5-dimethyl-3-hexyn-2,5-diol

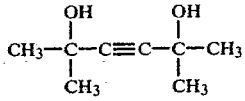

For instance, half the weight, i.e., 15 g., of the organic polymer component of Example 2 was used plus 5–10 g. of added acetylenic alcohol and the resulting phosphatized coating on galvanized steel had an increased coating weight.

Example 9

Completing the Phosphatizing Treatment

After the phosphatizing treatment has been applied on plain steel and on galvanized steel, it is desirable to wash off the unreacted residue on the treated area. This can be done either by a cold water rinse or a warm water rinse. Alternatively, the same procedure can be used as is used in washing off the residue from conventional phosphatizing treatments on plain steel surfaces. Such steps consist of washing with a water rinse, a so-called chromic acid rinse or rinse containing chromic acid as well as the phosphoric acid and again followed by a water rinse.

In the case of the phosphatizing treatments of the present invention, this final rinse can be combined with a further modification of the organic polymer component by rinsing the phosphatized surface with a water rinse containing an acetylenic alcohol, such as the acetylenic alcohols listed in Example 8 or other acetylenic alcohols using, for instance, 15 g. acetylenic alcohol to 550 g. water. Otherwise, the procedure is as outlined before.

In industrially preparing plain or carbon steel or automotive steel on large scale, there frequently arises a variation in the complete dispersion of the carbon throughout and on the surface of the carbon steel. Such local carbon-accumulated areas are not reactive with the applied phosphatizing solution and in spite of such applied treatment premature corrosion failures later occur in such localized carbonaceous areas. Even after application of a protective primer coat, on exposure to a corrosive atmosphere, for instance in the saltfog chamber, premature corrosion failure has occurred throughout industrial practice wherever such unreacted local carbonaceous areas are present.

However, when a zinc coating or a galvanization had been applied to the carbon steel surface before the phosphatizing treatment, such local carbonaceous areas have been overcoated by the zinc coating first and therefore more uniform phosphatized conditions result from the application of the present invention.

Example 10

Determining the Degree of Accomplished Interreaction within the Applied Phosphate Treatment The degree of completed interreaction-coatings was established by measuring the amount of residual water-soluble matter in the treated surface. This was accomplished by immersing the treated surface into distilled water and following the decrease of its electrical resistance as a factor of time due to the release of the residual soluble matter into the water. This can be performed by use of a conductivity bridge (such as Industrial Instruments Model RC 16) and using the initial resistance of water itself as 100%. An immersion of an untreated galvanized panel resulted after 10 minutes in a decrease of 10.1% and after 20 minutes in a decrease of 21.7%, but a treated panel according to this invention showed after 10 minutes a decrease of only 5.9% and after 20 minutes a decrease of only 11.8%.

For comparison, the immersion of a present day commercial zinc phosphatized automotive steel panel resulted after only 7.6 minutes in a decrease by 20.3%. Accordingly, the immersed panels show under continuing immersion a corresponding tendency toward progressing corrosion.

Example 11

Determination of the "Coating Weight" over Zinc-Coated Surfaces

In the art of phosphatizing steel, it is a general practice in the industry to determine the thickness of the phosphatized coating as an expression of the corrosion resistance provided to the steel surface. This is done by "stripping" the reaction layer off the phosphatized steel, for instance, by a short immersion in a solution of hydrochloric acid/formaldehyde and by then calculating the amount of the measured weight decrease due to such "stripping" of the reaction coating in milligrams of coating per square foot of treated surface. The industry uses such values for "coating weight" in its specifications for different industrial fields. It is a general practice in the automotive industry to require a coating weight of 150–300 mg./sq. ft. This protective layer represents the actual degree of corrosion resistance over the steel surface and at the interface between the steel and the subsequent organic protective and decorative coatings. Since factory steel deliveries vary in their condition and might have at and near the surface certain carbon inclusions which cannot participate in the phosphatizing reactions of the metal, even such low specified degrees of protection might not always be achieved.

On the other hand, a standard type of galvanizing of the steel surface corresponds to 10,000–14,000 mg. protective zinc layer per square foot of steel surface which represents a much greater degree of corrosion resistance. However, it was not possible before the present invention to achieve a uniform and reliable bond between a galvanized or zinc-coated steel surface and a subsequent organic protective and decorative coating and to cover the "spangle" appearance on the zinc-coated surface.

A primer paint coating applied directly to galvanized steel, when exposed to a drop of a 28 inch-pound weight, will crack open in the impact area and lose its protective value. When the zinc-coated surface had been phosphatized in accordance to the preceding examples of the present invention, no such cracks occurred in the primer paint coating and the coating system remained unchanged after the weight drop. Moreover, such galvanized and subsequently phosphatized surfaces can be measured again by a removal of the phosphatizing layer and the galvanizing layer and so the total thickness of these two protective layers can be determined.

In order to achieve this, a section of the galvanized (but not as yet phosphatized) steel is immersed in the same hydrochloric acid/formaldehyde stripping solution for a certain immersion period. The same is done on another section after the galvanized surface has been phosphatized in accordance with the present invention. From the difference in the two weights, the coating weight of the actual phosphatized coating can be determined.

Thus, when an unphosphatized galvanized steel had a zinc-stripping weight of 14,446 mg./sq. ft. and when such stripping weight had increased by 706 mg./sq. ft. and by 1291 mg./sq. ft. after 3 and 5 minutes, respectively, of phosphatizing treatment, such increased values represent the coating weight of the phosphatized coating. By dividing such values by the number of minutes of immersion in the phosphatizing solutions, the formation of the reaction coating can be calculated in milligram per square foot per minute. (In the preceding examples, the values were 235 mg./sq. ft./minute after 3 minutes and 258 mg./sq.ft./minute after 5 minutes of phosphatizing treatment.) Since these phosphatized coating weight values occur on top of the earlier applied corrosion resistant zinc deposit, the resulting and so-measured total protection for the steel is very valuable.

Example 12

Influence of Other Added Metals

When the phosphatizing solution according to Example 2 contains a metal in addition to molybdenum or the other above-listed metals, the effectiveness of the phosphatizing solution might be influenced in different manner according to the added metal. However, it was found that the presence of limited amounts of aluminum did not interfere with the subsequent application of the phosphatizing solution to galvanized steel.

Example 13

Application of the Phosphatizing Solution to other Metal Deposits on Steel

Since the present invention has established that the phosphatizing effectiveness depends on the use of metals in the phosphatizing solution which are different from the metals of the coated surface to be phosphatized, the same phosphatizing solution in accordance with Example 2 can also be used on metal coated surfaces other than zinc-coated surfaces.

Thus, a lead-coated steel, such as electro-terne (containing small amounts of tin eventually), was subjected to the same phosphatizing treatment as described in the above examples for zinc-coated steel, but extending the immersion time in the phosphatizing solution of Example 2 to 6–8 minutes. A dark reaction coating was formed. Since the lead itself is only very slightly and slowly soluble in the hydrochloric acid/formaldehyde stripping solution, forming a $PbCl_2$ ("Lead Chemicals" by D. Greininger and coworkers ILZRO 1975 Tables 1–4), the stripping under a 20 seconds immersion time was made here on the phosphatized panels directly. Coating weights of 192 to 224 mg./sq. ft. were obtained.

Tin-plated steel and copper-plated steel also showed a phosphatizing effect by treatment with the phosphatizing solution of Example 2. However, in accordance with the invention the copper-plated steel was not treated with a copper-containing phosphatizing solution.

Example 14

Replenishing of the Phosphatizing Solution under Continuous Application

When the phosphatizing solutions of the foregoing Examples 1–13 have been used repeatedly in the treating of steel surfaces of the above-mentioned types, their composition is gradually depleted or spent. Thus, the molybdenum (or other applied metal) content decreases due to the chemical formation of the new phosphatized deposits and, in the case of phosphatizing zinc-coated (galvanized) steel surfaces, the zinc content increases due to a dissolving of the zinc from the zinc-coated surfaces which are being phosphatized. The actual composition can be checked periodically by exposing samples of the phosphatizing solution to the flames of an atomic absorption measuring instrument. In order to obtain specific readings for the molybdenum (or the other above-listed metals) content the instrument is used with the Tekmar Hollow Cathode Lamp for molybdenum (or other used metals) and for readings of the zinc content it is used with the corresponding lamp for zinc.

The depleted or spent phosphatizing baths can be replenished by addition of a "refresher solution" mentioned above, i.e., a "concentrated solution" of the corresponding dilute phosphatizing bath.

If the pH should become too acidic, a small amount of ammonium hydroxide can be used to restore the above-mentioned preferred pH range of 2.8 to 3.4.

Example 15

Application to One-Sided Galvanized Steel

In recent years, one-sided galvanized steel has been employed in order to utilize the higher corrosion resistance of the galvanized side and to utilize the other plain steel side as a basis for the application or organic decorative coatings. However, it has been observed that under corrosive conditions electrolytic corrosion occurs along the edges where the two metals had jointly been exposed. The process of the present invention enables the phosphatization of both sides simultaneously. Thereafter, both sides are in a phosphatized condition where no such electrolytic corrosion can occur. Organic decorative coatings can be applied to both sides over their phosphatized surfaces.

In summary of the foregoing disclosure and data, the phosphatizing solution or bath used in the process of the present invention comprises a diluted aqueous solution of components which allow and promote the development of metal phosphates or metal acid phosphates from the metal group of this process formed in the bath in a status nascendi thereby producing a reactive condition which results when contacted with metal surfaces in the formation of a reaction coating. Such reaction coatings when developed on galvanized steel represent a molybdenum or other above-listed metal phosphate or acid phosphate interreaction product with the zinc surface of the galvanized steel. When applied to the steel itself, it represents an interreaction product between the molybdenum or other above-listed metal phosphate or acid phosphate with the iron on which the interreaction coating is developed. The phosphatizing solution can also be used to produce such interreactions simultaneously with the zinc surface of the galvanized steel and with the steel of joints between steel forms (such as automotive steel) and the galvanized steel. When a ligand-forming organic polymer is introduced into such solutions in which the formation of the molybdenum or other above-listed metal phosphate or acid phosphate takes place, such ligand-forming organic polymer becomes a component in the new reaction product.

The foregoing disclosure has pointed out that for such formation of the desired molybdenum or other above-listed metal phosphate or acid phosphate grouping the molybdenum trioxide or other above-listed metal oxides can be introduced into solutions which contain the required phosphate ions in the form of an alkali metal phosphate or alkali metal acid phosphate or in combinations of such phosphates with limited amounts of phosphoric acid or in the form of a diluted phosphoric acid itself. Details about the preferred concentrations for the various participating components are given in the preceding examples. The reaction is not critically influenced by variations in the added amounts of water as diluent for accomplishing the immersion or the spray applications. The rate of the reaction can be influenced by the addition of a limited amount of an acetylenic alcohol.

When the phosphatizing solution has been used as an immersion bath for the phosphatizing of galvanized steel, some of the zinc coating might be attacked by the acidic phosphate ions of the phosphatizing solution and can then enter the solution as a zinc phosphate or zinc acid phosphate component. Some zinc oxide might have been introduced into the solution together with the molybdenum trioxide (or other above-listed metal oxide) or some zinc phosphate or zinc acid phosphate might have been added to the phosphatizing bath. In these cases, such zinc phosphate or zinc acid phosphate formations can enter the applied molybdenum (or other above-listed metal) phosphate or acid phosphate coatings without interfering with their formation.

The phosphatizing bath can be used in the treating of the above-mentioned metal surfaces to inhibit surface corrosion by immersion of the metal surface in the phosphatizing bath for from about 1 to about 5 minutes or for a time sufficient to provide the desired surface coating weight. Alternatively, the phosphatizing bath can be sprayed under pressure upon the metal surface under selected spraying conditions. The resulting phosphatized metal surface containing the ligand-forming organic polymer can be subsequently further modified by rinsing with a water rinse containing from about 2 to about 4 parts by weight of an acetylenic alcohol per 100 parts by weight of water.

When the phosphatizing bath has been depleted of reactive components due to extended use, it can be replenished by adding a refresher solution which comprises one of the prepared phosphatizing baths of the preceding examples in their concentrated form before they had been diluted to the application state. After the addition of the refresher solution, the preferred pH of the phosphatizing bath still is from about 2.8 to about 3.4.

The phosphoric acid commonly used in practice of the invention is orthophosphoric acid (85%). However, corresponding adjusted amounts of orthophosphoric acid of another concentration can be used and other forms of phosphoric acid (instead of orthophosphoric acid) can be used as well.

What is claimed is:

1. A process for inhibiting corrosion, providing an adherent foundation, and, in the case of a zinc-coated surface, eliminating the irregular appearance due to a surface condition which is usually described as the formation of a "spangle" pattern, by pretreating metal surfaces for subsequent application of organic coating systems which comprises treating a metal surface with a phosphatizing bath comprising a reactive aqueous solution or dispersion prepared by introducing a metal oxide of a metal other than the metal of the metal surface to be treated into an aqueous medium containing phosphate ions released from the dissolving or dispersing of an alkali metal phosphate or an alkali metal acid phosphate or phosphoric acid or combinations thereof and introducing a ligand-forming organic polymer into said aqueous medium; said introduced metal oxide being an oxide of a metal selected from the group consisting of molybdenum, vanadium, tungsten, lead, titanium, manganese and copper; and said metal oxide being introduced in an amount approximately stoichiometric with said phosphate ions;

whereby there is formed in said aqueous medium a metal phosphate or a metal acid phosphate of the introduced metal oxide by reaction between the introduced metal oxide and the phosphate ions which is capable of interreacting with the metal of the metal surface being treated and resulting in a protective reaction coating comprised of the metal component of the introduced metal oxide as well as of the metal of the treated metal surface together with the phosphate ions of the phsophatizing bath; said ligand-forming organic polymer being introduced into said aqueous medium in an amount of from about 5% to about 10% by weight of the reaction-formed metal phosphate or metal acid phosphate in said aqueous medium and becoming a part of said protective reaction coating;

following which the treated metal surface is washed with a water rinse, a so-called chromic acid rinse or rinse containing chromic acid as well as phosphoric acid and again followed by a water rinse.

2. The process of claim 1 wherein the reaction between the introduced metal oxide and the phosphate ions results in a formation of the metal phosphate or the metal acid phosphate of the introduced metal oxide in a status nascendi so that a strong reactivity occurs in the treating of the metal surface.

3. The process of claim 1 wherein the metal surface is a steel surface.

4. The process of claim 1 wherein the metal surface is a zinc- or lead- or copper- or tin-coated surface.

5. The process of claim 1 wherein the metal surface is a joint of steel with a zinc- or lead- or copper- or tin-coated surface.

6. The process of claim 1 wherein the metal surface is one one side a bare steel and on the other side a zinc- or lead- or copper- or tin-coated surface.

7. The process of claim 1 wherein the introduced metal oxide is selected from the group consisting of molybdenum trioxide, vanadium pentoxide, tungsten trioxide, titanium dioxide, manganese dioxide, cuprous oxide and lead monoxide.

8. The process of claim 1 wherein the introduced metal oxide is first dispersed in a dispersing amount of a dispersing agent selected from the group consisting of formamide and alkyl-substituted formamide.

9. The process of claim 1 wherein the introduced ligand-forming organic polymer is a water-dispersible polymer selected from the group consisting of polyvinyl alcohol and methyl cellulose.

10. The process of claim 1 wherein a dialdehyde, preferably glyoxal, is introduced into said aqueous medium as an accelerator in an amount sufficient to increase the final cure of the ligand-forming organic polymer.

11. The process of claim 1 wherein the phosphatizing bath has a pH between about 2.8 and about 3.4.

12. The process of claim 1 wherein the phosphatizing bath has a temperature in the range between about 60° C. to about 80° C.

13. The process of claim 1 wherein the reactivity of the introduced ligand-forming organic polymer in the phosphatizing bath is increased by addition of an acetylenic alcohol into said aqueous medium, in an amount of from about 0.25 to about 0.76 parts by weight of the acetylenic alcohol per 1 part by weight of the ligand-forming organic polymer.

14. The process of claim 1 wherein the treated metal surface is heated to cure the ligand-forming organic polymer.

15. The process of claim 1 wherein the metal surface is treated by immersing it in the phosphatizing bath.

16. The process of claim 1 wherein the produced reaction deposit on the treated metal surface represents due to the polymeric ligand component a coherent film-like deposit instead of the primarily crystalline one obtained without such ligand component.

17. The process of claim 1 wherein the produced film-like deposit increases the resistance of the coating against the penetration of moisture or other corrosion promoting factors as well as minimizing, in the case of a zinc-coated surface, the appearance of a "spangle" pattern.

18. The process of claim 1 wherein the metal surface is treated by spraying it with the phosphatizing bath.

19. The process of claim 1 wherein the metal-treated surface is a one-sided galvanized or two-sided galvanized steel with the additional aim to decrease by this treatment the spangle appearance of such galvanized surface.

20. A phosphatized metal surface produced by the process of claim 1.

21. A phosphatized metal surface produced by the process of claim 13.

* * * * *

UNITED STATES PATENT AND TRADEMARK OFFICE

CERTIFICATE OF CORRECTION

PATENT NO. : 4,233,088

DATED : November 11, 1980

INVENTOR(S) : Max Kronstein

It is certified that error appears in the above—identified patent and that said Letters Patent is hereby corrected as shown below:

Col. 2, line 15, "(monobasic" should read -- (monobasic) --. Col. 5, after the paragraph ending at line 33, insert the following paragraph: -- In a second step, 275 g. sodium acid phosphate (monobasic) were dissolved in 960 g. water with addition of 29 g. phosphoric acid (85%) in the same manner as in Example 1. --; col. 5, delete lines 34 through 37; line 38,"30 l g." should read -- 30 g. --. Col. 7, line 3, "Solution A" should not appear as a heading but should follow line 1 and complete that sentence; line 11, "weight" should read -- weights --. Col. 13, line 30, "or" should read -- of --. Col. 15, line 24, "phsophatizing" should read -- phosphatizing --; line 51, "one one" should read -- on one --.

Signed and Sealed this

Tenth Day of March 1981

[SEAL]

Attest:

RENE D. TEGTMEYER

Attesting Officer

Acting Commissioner of Patents and Trademarks